US010781018B1

(12) United States Patent
Squires

(10) Patent No.: US 10,781,018 B1
(45) Date of Patent: Sep. 22, 2020

(54) CONTAMINANT RESISTANT PRODUCT PACKAGING

(71) Applicant: Charlotte Squires, Spokane, WA (US)

(72) Inventor: Charlotte Squires, Spokane, WA (US)

( * ) Notice: Subject to any disclaimer, the term of this patent is extended or adjusted under 35 U.S.C. 154(b) by 0 days.

(21) Appl. No.: 16/655,055

(22) Filed: Oct. 16, 2019

(51) Int. Cl.
*B65D 47/00* (2006.01)
*B65D 47/32* (2006.01)
*B65D 81/34* (2006.01)
*B65D 77/22* (2006.01)

(52) U.S. Cl.
CPC ..... *B65D 47/32* (2013.01); *B65D 77/22* (2013.01); *B65D 81/34* (2013.01); *B65D 2205/02* (2013.01)

(58) Field of Classification Search
CPC ..... B65D 47/32; B65D 77/22; B65D 81/34; B65D 2205/02
USPC ..... 383/100
See application file for complete search history.

(56) References Cited

U.S. PATENT DOCUMENTS 5,142,970 A * 9/1992 Erkenbrack ..... A23L 3/0155 206/524.8
5,380,093 A * 1/1995 Goldman ..... B65D 33/01 210/464
6,170,985 B1 * 1/2001 Shabram, Jr. ..... B65D 33/01 383/100
7,322,748 B1 * 1/2008 Rubin ..... A47J 36/027 383/100
7,490,623 B2 * 2/2009 Rypstra ..... B65D 77/225 137/246
8,157,445 B2 * 4/2012 Kurosawa ..... B65D 81/3461 383/100
8,608,379 B2 * 12/2013 Madai ..... B65D 33/01 383/45
8,720,729 B2 * 5/2014 Madai ..... B65D 77/225 220/367.1
8,777,486 B2 * 7/2014 Miyake ..... B65D 77/225 383/103

OTHER PUBLICATIONS

Zhang et al., "Tuning the gradient structure of highly breathable, permeable, directional waster transport in b-layered Janus fibrous membranes using electrospinning", Royal Society of Chemistry, RSC Adv., 2020, 10, 13529-3538.

* cited by examiner

*Primary Examiner* — Peter N Helvey
(74) *Attorney, Agent, or Firm* — Mohr Intellectual Property Law Solutions, PC

(57) ABSTRACT

A sealable enclosure is disclosed that is configured to enclose an object that is to be heated, wherein heating of the sealable enclosure with the object sealed therein permits gas generated by the heating to vent out through a first micro-perforation portion disposed in an enclosure, wherein the gas vents into a cavity formed between the outside surface of the enclosure, a lower surface of a file layer, and a strip of heat sensitive adhesive. When the temperature of the strip of heat sensitive adhesive reaches a threshold temperature, the strip of heat sensitive adhesive releases so that the gas may vent from the cavity through a second micro-perforation portion disposed in the film layer out into an ambient region surrounding the sealable enclosure while preventing ambient contaminates in the ambient region from entering into the sealable enclosure.

19 Claims, 4 Drawing Sheets

CONTAMINANT RESISTANT PRODUCT PACKAGING

BACKGROUND

The present disclosure relates generally to product packaging. Known product packaging is not satisfactory for situations where contamination from ambient contaminants is of concern. For example, a gluten free product cannot be baked in an ambient environment that is not entirely free of gluten particles. In such situations where cooking occurs in an ambient environment with gluten contamination, the gluten free product may become contaminated with gluten particles from the ambient environment during baking and/or during handling of the baked product after baking.

As another example, some individuals are highly allergic to peanuts or other particles. When a meal is prepared for such at-risk individuals, special procedures and/or equipment is required for safe food preparation so that the prepared meal is not contaminated with peanut particles.

As yet another example, some non-food product items may need to be heated in a package such that ambient contaminants do not enter the product package during and/or after heating. An example is sterilization of medical equipment.

Accordingly, there exists a need in the product packaging arts for improved product packaging that protects packaged products for contaminants.

SUMMARY

The present disclosure is directed to a sealable enclosure that is configured to enclose an object that is to be heated, wherein heating of the sealable enclosure with the object sealed therein permits gas generated by the heating to vent out through a first micro-perforation portion disposed in an enclosure, wherein the gas vents into a cavity formed between the outside surface of the enclosure, a lower surface of a file layer, and a strip of heat sensitive adhesive. When the temperature of the strip of heat sensitive adhesive reaches a threshold temperature, the strip of heat sensitive adhesive releases so that the gas may vent from the cavity through a second micro-perforation portion disposed in the film layer out into an ambient region surrounding the sealable enclosure while preventing ambient contaminates in the ambient region from entering into the sealable enclosure.

DETAILED DESCRIPTION

Figure 1:
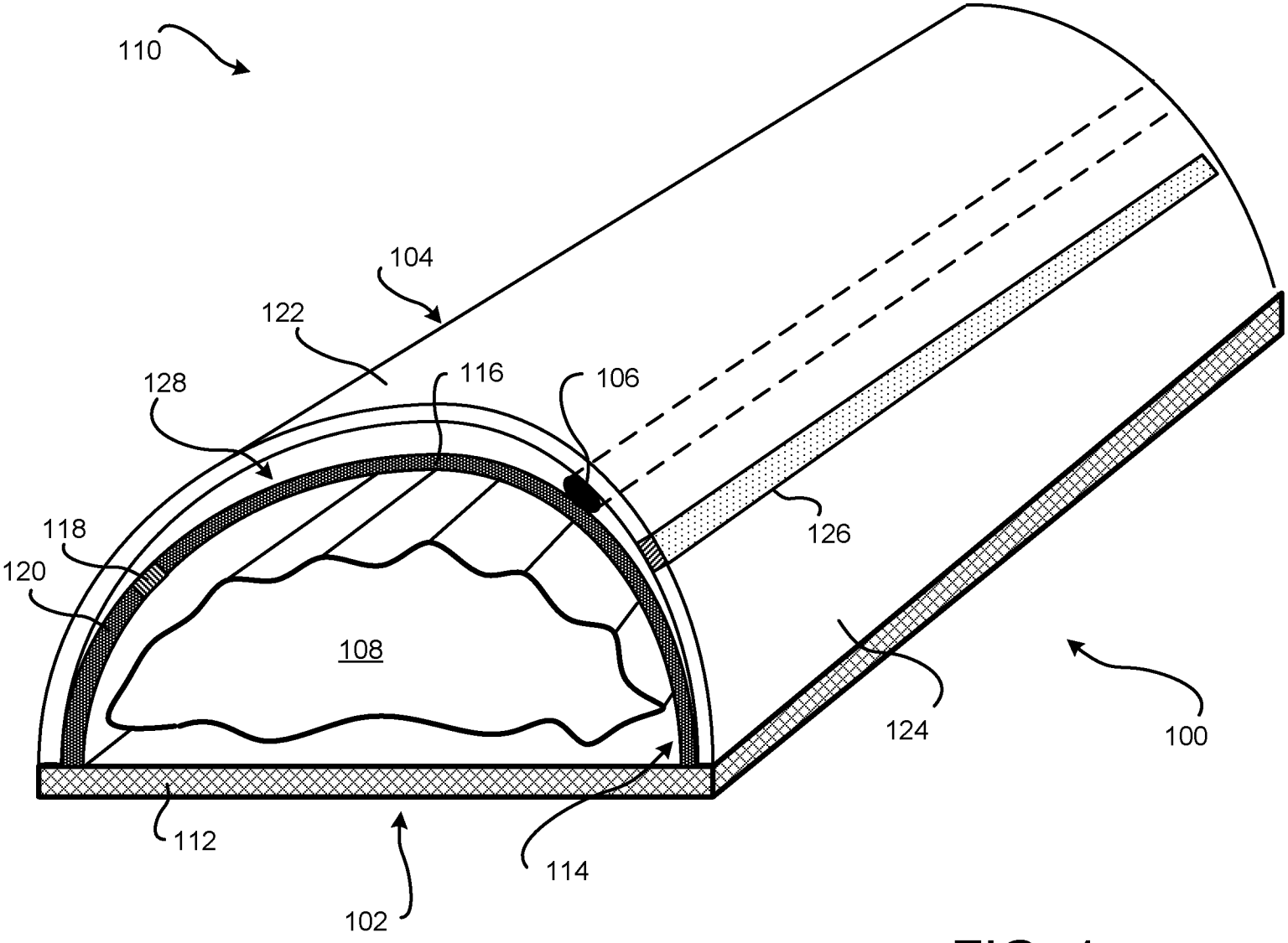
FIG. 1 is a perspective view of a film layer of an example sealable enclosure embodiment.

Heating of a sealable enclosure embodiment with an object sealed therein permits gas generated by the heating to vent out from the sealable enclosure into an ambient region surrounding the sealable enclosure while preventing ambient contaminates in the ambient region from entering into the sealable enclosure. The disclosed sealable enclosure embodiments will become better understood through review of the following detailed description in conjunction with the figures. The detailed description and figures merely provide examples of the various invention embodiments described herein. Those skilled in the art will understand that the disclosed example embodiments may be varied, modified, and altered without departing from the scope of the invention as described herein. Many variations are contemplated for different applications and design considerations. However, for the sake of brevity, each and every contemplated variation is not individually described in the following detailed description.

Throughout the following detailed description, examples of various sealable enclosure embodiments are provided. Related features in the example embodiments may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example embodiment.

The following definitions apply herein, unless otherwise indicated. "Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder. "Comprising," "including," and "having" (and conjugations thereof) are used interchangeably to mean including but not necessarily limited to, and are open-ended terms not intended to exclude additional elements or method steps not expressly recited. Terms such as "first", "second", and "third" are used to distinguish or identify various members of a group, or the like, and are not intended to denote a serial, chronological, or numerical limitation. "Coupled" means connected, either permanently or releasably, whether directly or indirectly, through intervening components. "Sealably join" or the like means that two adjacent surfaces are affixed together (sealed together) in a manner such that fluids and/or gasses cannot pass between the two joined surfaces. Micro-perforated food packaging is a type of perforated packaging that contains micro holes, which enable gas permeation to maintain the rate of respiration of food products. Micro-perforation involves the puncturing of packaging films with holes ranging from, but not limited to, a diameter of 30 microns (μm) to 200 μm. Micro-perforated food packaging offers various advantages including extended shelf life and moisture retention of the food products. Embodiments of the sealable enclosure employ micro-perforation (a micro-perforation portion of the packaging) in a novel manner to prevent contamination from ambient contaminants when the object that is enclosed within the sealable enclosure is heated.

FIG. 1 is a cross sectional, perspective view of an example embodiment of a sealable enclosure 100. The sealable enclosure 100 comprises three elements: an enclosure 102, a film layer 104 and a strip of heat sensitive adhesive 106. The sealable enclosure 100 is configured to enclose an object 108 that is to be heated while in an ambient region 110. Gas that is generated by the heating of the object 108 is allowed to vent out from the sealable enclosure 100 into the ambient region 110 surrounding the sealable enclosure 100 while preventing ambient contaminates residing in the ambient region 110 from entering into the sealable enclosure 100.

Prior to heating, the object 108 is inserted into the enclosure 102 and then the enclosure 102 is sealed. Any suitable sealing process and/or apparatus may be used to seal the object 108 within the enclosure 102. Further, since the object 108 has been sealed into the enclosure 102, contaminants cannot enter into the inside of the enclosure 102 to contaminate the object 108. For example, prior to heating, the object 108 cannot be contaminated during transportation to the heating site and/or during handling of the sealable enclosure 100 by individuals.

To illustrate a practical application of the use of example sealable enclosure 100 embodiments, the object 108 may be a formed piece of gluten free dough that is to be baked into a gluten free loaf of bread while encased within the sealable enclosure 100. In an example heating application, the ambient region 110 may be the inside of a baking oven. If gluten-based dough has been previously baked within the oven, then residual gluten particles may still reside inside of the oven (the ambient region 110). Embodiments of the sealable enclosure 100 prevent contamination of the gluten free dough (the object 108) by preventing gluten particles in the ambient region 110 from entering into the sealable enclosure 100 during the baking process.

As another application, the object 108 may be a liquid or semi-liquid, like milk or apple sauce, that is to be sterilized. In such applications, the size (diameter) of the micro-perforations are defined to prevent liquid from passing through the micro-perforations while permitting the generated gas to pass through the micro-perforations. As yet another application, the object 108 may be a physical object such as a medical instrument that is to be sterilized in an autoclave.

In the various embodiments, the enclosure 102 comprises a base portion 112 and an upper portion 114. The upper portion 114 comprises a first enclosure barrier portion 116, a micro-perforation portion 118, and a second enclosure barrier portion 120. The micro-perforation portion 118 is located between the first enclosure barrier portion 116 and the second enclosure barrier portion 120. The base portion 112, the first enclosure barrier portion 116 and the second enclosure barrier portion 120 are impenetrable to the generated gas and the ambient contaminates. The micro-perforation portion 118 is configured to permit the gas generated by the heating to initially vent out from the enclosure 102.

The micro-perforation portion 118 is a structure, such as layer of film, paper or the like, with a plurality of small diameter holes therein. In a preferred embodiment, the width of the first enclosure barrier portion 116 is substantially larger than the width of the second enclosure barrier portion 120 such that the micro-perforation portion 118 is located closer to a selected one of the edges of the upper portion 114. Any suitable size (width and/or length) of the micro-perforation portion 118 may be used in the various embodiments. Further, any suitable number of micro-perforations (micro-holes) may be used for the micro-perforation portion 118. In some embodiments, the micro-perforation portion 118 may comprise multiple discrete micro-perforation portions that may reside in selected suitable locations of the upper portion 114.

In some embodiments, the three portions 116, 118, 120 are initially separate structures that are then joined to form the upper portion 114. Depending upon the embodiment, an adhesive may be used to sealably join the edges of the three portions 116, 118, 120. Alternatively, a crimp or other structure may be used to sealably join the edges of the portions 116, 118, 120. A crimp is formed by pressing together one or more folds in the material so that the folded portions are sealably captured together (joined). In another embodiment, the edges of the three portions 116, 118, 120 are sealably joined using heat and/or pressure.

In other embodiments, the three portions 116, 118, 120 are formed on a sheet of solid flat material, film, layer, or the like. The micro-perforation portion 118 is formed in a selected region on the structure. A plurality of micro-perforation portions are formed by perforating the structure using a die or a laser.

In some embodiments, the base portion 112 and the upper portion 114 are fabricated from the same piece of material. For example, but not limited to, the enclosure 102 may be a tube of packaging material.

In another embodiment, the base portion 112 may be separate from the upper portion 114, such that the edges of the base portion 112 and the upper portion 114 are joined together in a sealable manner. For example, the base portion 114 may be made from a rigid material that supports the object 108. In contrast, the upper portion 114 may be a flexible or semi-rigid structure to facilitate packaging and/or heating of the object 108. Depending upon the embodiment, an adhesive may be used to sealably join the edges of the base portion 112 and the upper portion 114. Alternatively, a crimp or other structure may be used to sealably join the edges of the base portion 112 and the upper portion 114. In another embodiment, the edges of the base portion 112 and the upper portion 114 are sealably joined using heat and/or pressure.

The film layer 104 comprises a first film barrier portion 122, a second film barrier portion 124, and an intervening micro-perforation portion 126. The edges of the film layer 104 are sealably affixed to a portion of the outer surface of the enclosure 102. The first film barrier portion 122 and the second film barrier portion 124 are impenetrable to the generated gas and the ambient contaminates. The micro-perforation portion 126 is configured to permit the gas generated by the heating to initially vent out from a cavity 128 that is defined by a portion of the surface of the upper portion 114 and a lower surface of the film layer 104.

Any suitable size (width and/or length) of the micro-perforation portion 126 may be used in the various embodiments. Further, any suitable number of micro-perforations (micro-holes) may be used for the micro-perforation portion 126. In some embodiments, the micro-perforation portion 126 may comprise multiple discrete micro-perforation portions that may reside in selected suitable locations of the film layer 104.

In a preferred embodiment, the three portions 122, 124, 126 are formed on a sheet of solid flat material, film, layer, or the like. The micro-perforation portion 126 is formed in a selected region on the structure, wherein a plurality of micro-perforations are formed by perforating the structure using a die or a laser. Preferably, the film layer 104 is made from a flexible or semi-flexible material such that when gasses are generated during the heating of the object 108, gas pressure from the expanding gas can enlarge the cavity 128.

A strip of heat sensitive adhesive 106 runs along the length of the first film barrier portion 122 of the film layer 104 and the first enclosure barrier portion 116 of the upper portion 114. Here, the strip of heat sensitive adhesive 106 extends from the front edge to the back edge of the film layer 104. The strip of heat sensitive adhesive 106 adhesively joins and seals a bottom surface portion of the first film barrier portion 122 to an outside surface portion of the first enclosure barrier portion 116.

During the heating process, one skilled in the art appreciates that gas is generated as increasing temperature within the enclosure 102 causes vaporization of liquids residing within the object 108 and/or residing in the interior of the enclosure 102. As the gas generated in the interior of the enclosure 102 initially vents out through the micro-perforation portion 118. The entering gas then expands and enlarges the cavity 128 that is defined by a lower surface of part of the first film barrier portion 122, the corresponding outer surface portion of the upper portion 114, and the strip of heat sensitive adhesive 106. At this juncture of the heating process, the strip of heat sensitive adhesive 106 that binds the lower surface of the first film barrier portion 122 of the film layer 104 with the outer surface of the corresponding first enclosure barrier portion 116 of the upper portion 114 prevents the expanding gas in the cavity 128 from venting out through the micro-perforation portion 126 of the film layer 104.

Because the heat sensitive adhesive 106 binds the lower surface of the first film barrier portion 122 of the film layer 104 with the outer surface of the corresponding first enclosure barrier portion 116, an unexpected benefit is that no contaminates from the ambient region 110 are able to enter into the cavity 128, thereby preventing the object 108 from becoming contaminated. That is, at this juncture in the heating process, it is not possible for the object 108 to become contaminated since the strip of heat sensitive adhesive 106 acts as an impenetrable barrier between the object 108 and the ambient region 110.

As the heating process continues the temperature of the strip of heat sensitive adhesive 106 increases. When the temperature of the strip of heat sensitive adhesive 106 reaches a predefined threshold temperature, the strip of heat sensitive adhesive 106 releases such that the lower surface of the first film barrier portion 122 of the film layer 104 separates from the outer surface of the corresponding first enclosure barrier portion 116 of the upper portion 114. Accordingly, the pressurized gas in the cavity 128 then vents out from the cavity 128 through the micro-perforation portion 126 of the film layer 104. Since the gas pressure of the cavity 128 exceeds the pressure of the ambient region 110, contamination particles that may reside in the ambient region 110 are not able to enter into the cavity 128 because there is no air inflow from the ambient region 110 into the cavity 128. Accordingly, the object 108 cannot become contaminated during the heating process since such contaminates cannot pass through the micro-perforation portions 118, 126 to enter into the interior of the enclosure 102.

In the various embodiments, the threshold temperature at which the strip of heat sensitive adhesive 106 releases is a temperature that is higher than the temperature at which gas is generated within the enclosure 102. Returning to the example of baking gluten free dough, one skilled in the art appreciates that the dough typically is baked in an oven at a temperature of between 325° F. (degrees Farenheight) and 425° F. Further, water is known to change from a liquid state to a gas state at a temperature of 212° F. Thus, as the temperature of the dough begins to exceed 212° F., the dough begins to release steam (gas) into the interior region of the enclosure 102. The steam vents through the micro-perforation portion 118 into the cavity 128. As the gas pressure increases and the temperature of the strip of heat sensitive adhesive 106 increases to the predefined threshold temperature, the strip of heat sensitive adhesive 106 begins to release. The steam then vents through the micro-perforation portion 126 out into the ambient region 110.

In the various embodiments, any suitable material may be used for the components of the sealable enclosure 100. Such materials include, but are not limited to, plastic, cellophane, cardboard, paper, polyethylene, polypropylene, metal, composites, or the like that are suitable for withstanding higher temperatures. Depending upon design choice and the nature of the object 108 that is to be enclosed within the sealable enclosure 100, the various components may be made of a rigid material, a semi-rigid material, a flexible material, and/or a semi-flexible material.

Furthermore, the predefined threshold temperature that the strip of heat sensitive adhesive 106 releases may be defined based on the type and/or characteristics of the adhesive material. Any suitable material may be used for the strip of heat sensitive adhesive 106.

Figure 2:
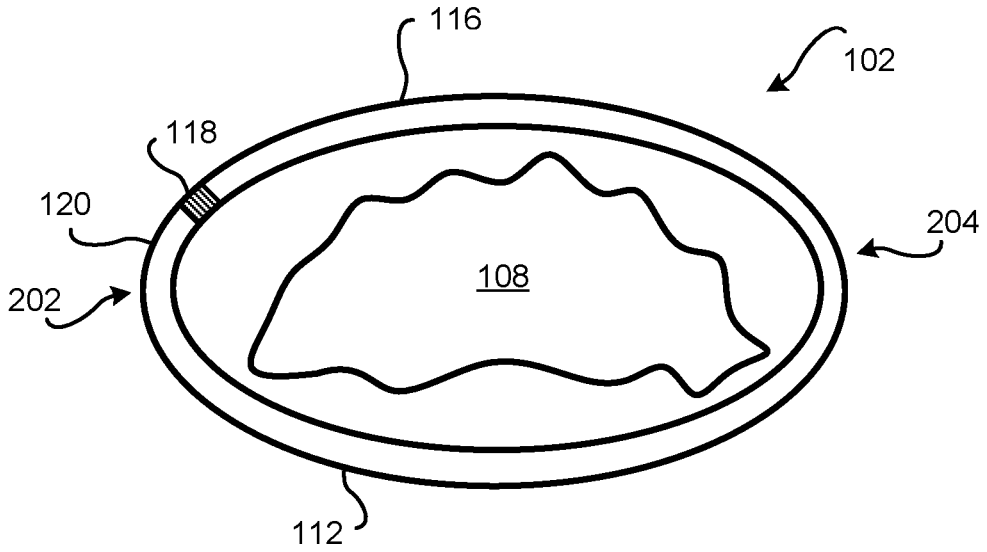
FIG. 2 is a cross sectional view of an example embodiment of the enclosure portion of an example sealable enclosure embodiment.

FIG. 2 is a cross sectional view of an example embodiment of the enclosure 102 portion of an example sealable enclosure embodiment 100. In this example embodiment, the enclosure 102 is fabricated as a tube that is configured to receive the object 108. Once the object 108 has been inserted into the tubular enclosure 102, the ends of the enclosure 102 may be sealed using any suitable process.

Figure 3:
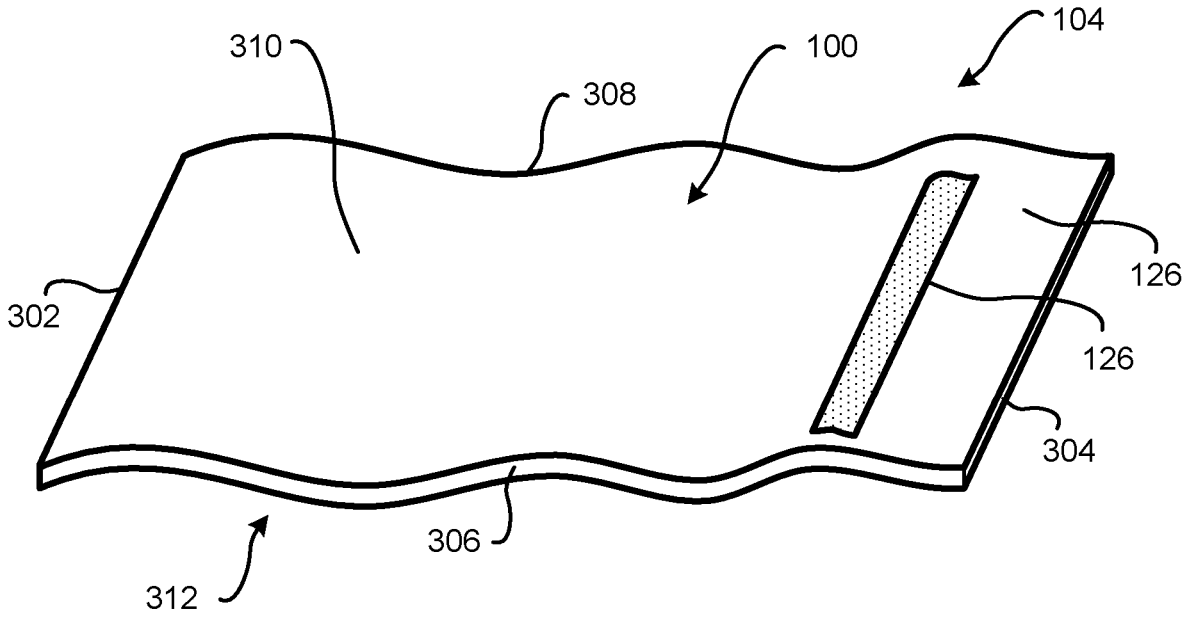
FIG. 3 is perspective view of the top surface of an example film layer of an example sealable enclosure embodiment.

FIG. 3 is perspective view of the top surface of an example film layer 104 of an example sealable enclosure embodiment 100. In this example embodiment, the film layer 104 is a flexible layer that is affixed to the tubular enclosure 102 illustrated in FIG. 2. In this example embodiment, edges of the film layer 104 may be affixed to the enclosure 102 generally at locations 202 and 204 (FIG. 2) on the tubular enclosure 102. In other embodiments, the film layer 104 may be affixed to other forms of an enclosure 102 embodiment.

The film layer 104 is defined by a first side edge 302, a second side edge 304, a front edge 306, a back edge 308, an upper surface 310 and a lower surface 312. The first side edge 302 is sealably affixed to the enclosure 102 at a selected location 202 (FIG. 2). The second side edge 304 is sealably affixed to the enclosure 102 at a selected location 204 (FIG. 2). After insertion of the object 108 into the enclosure 102, the front edge 306 and the back edge 306 may be sealably joined with the ends of the tubular enclosure 102 when the object 108 is sealed into the enclosure 102. Alternatively, the front edge 306 may be sealably joined to a selected outer surface region of the second enclosure barrier portion 120 of the enclosure 102 and the back edge 306 may be sealably joined to a selected outer surface region of the first enclosure barrier portion 116 of the enclosure 102 such that the film layer 104 covers the outer surface region of the first enclosure barrier portion 116, the micro-perforation portion 118, and the second enclosure barrier portion 120 portion of the enclosure 102. Here, the micro-perforation portion 118 of the enclosure 102 is proximate to the first edge 302 of the film layer 104.

In practice, the strip of heat sensitive adhesive 106 may be affixed to the bottom surface 308 of the film layer 104 prior to affixing the film layer 104 to the enclosure 102. In other embodiments, the strip of heat sensitive adhesive 106 may be inserted between the enclosure 102 and the film layer 104 at a desired location after the film layer 104 has been affixed to the enclosure 102.

Figure 4:
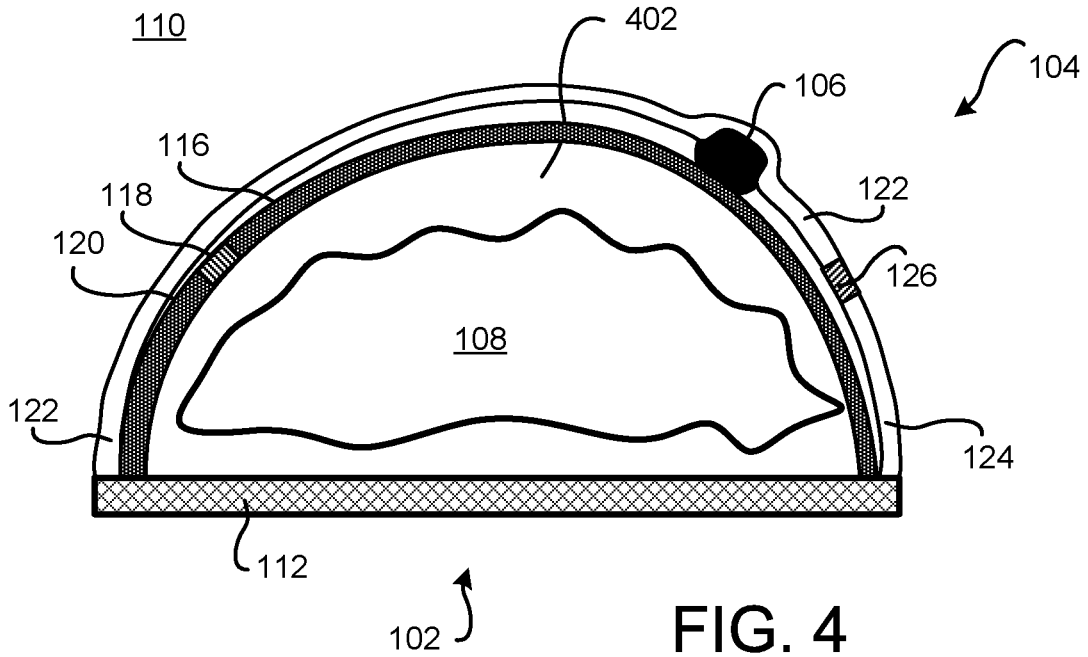
FIG. 4 is a cross sectional view of an example sealable enclosure embodiment before heating.

FIG. 4 is a cross sectional view of an example sealable enclosure embodiment before the heating of the object 108. In this simplified hypothetical example, the film layer 104 is illustrated for convenience as a flexible film layer that is collapsed onto the outside surface of the upper portion 114. Accordingly, the cavity 128 has not yet been formed by the generated gasses that will be venting out through the micro-perforation portion 118 during the heating process. In other applications, such as when the film layer 104 is a semi-flexible, semi-rigid or rigid material, the cavity 128 may be present but at a pressure that is the same as, or substantially the same as, the ambient pressure.

Figure 5:
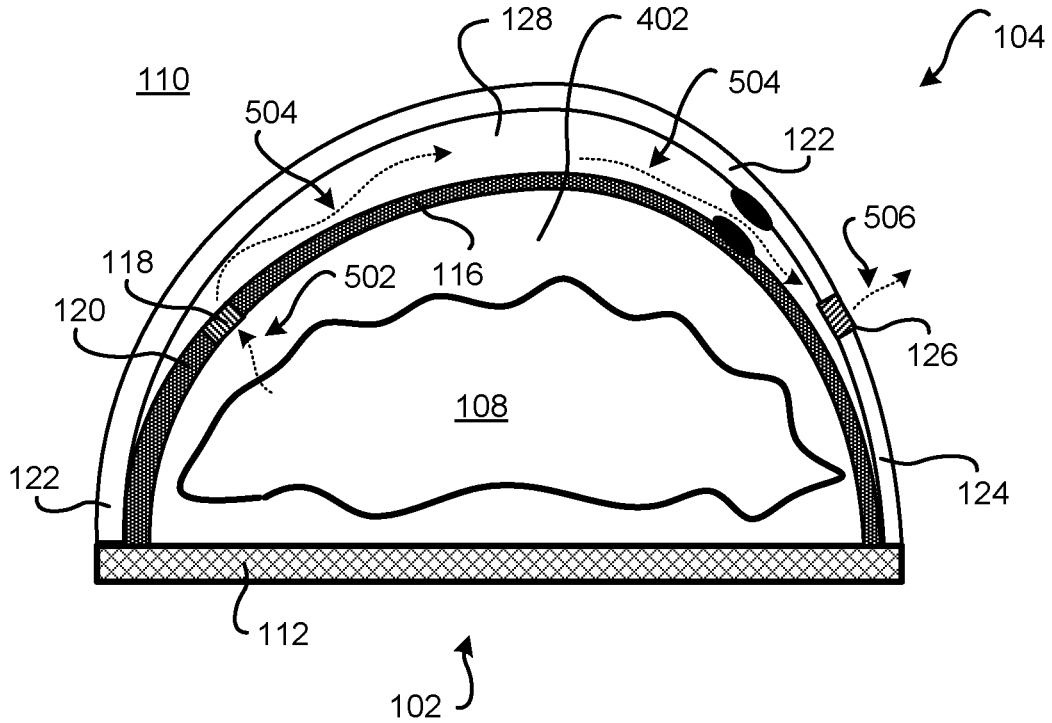
FIG. 5 is a cross sectional view of an example sealable enclosure embodiment during the heating and gas venting process.

FIG. 4 also illustrates the first film barrier portion 122 collapsed around the strip of heat sensitive adhesive 106. Accordingly, one skilled in the art appreciates that there are no separation type forces being exerted on the first film barrier portion 122 of the film layer 104 that would otherwise tend to separate or release the strip of heat sensitive adhesive 106. FIG. 5 is a cross sectional view of an example sealable enclosure embodiment during the heating and the gas venting process.

As the sealable enclosure 100 with the enclosed object 108 is heated, the temperature of the sealable enclosure 100 and the object 108 begins to increase. Returning to the example of baking gluten free dough, one skilled in the art appreciates that the gluten free dough enclosed in the sealable enclosure 100 is placed into a pre-heated oven for baking, typically at a baking temperature of between 325° F. (degrees Fahrenheit) and 425° F., or other customary baking temperatures which may be higher or lower than the described range. As the temperature of the gluten free dough increases during the baking process, water within the gluten free dough changes from a liquid state to a gas state (steam) and begins to fill the region 402 within the interior of the enclosure 102. At some point, the generated steam begins to pass through the micro-perforation portion 118 and into the cavity 128, as conceptually illustrated in FIG. 5 by the arrow 502.

As the pressure of the generating gas increases as more gas is released from the object 108, gas pressure increases in the interior region 402 of the enclosure 102. Since the pressure of the cavity 128 tends to equalize with the gas pressure of the interior region 402 of the enclosure 102, gas flows through the micro-perforation portion 118 into the cavity 128. The increasing pressure in the cavity 128 tends to expand the film layer 104 such that the film layer 104 extends to its maximum limits. At this juncture, the temperature of strip of heat sensitive adhesive 106 is less than the predefined threshold temperature at which the strip of heat sensitive adhesive 106 releases.

When the film layer 104 has expanded to its maximum extent, gas pressure will begin to increase in the cavity 128 and the interior region 402 of the enclosure 102. Meanwhile, temperature of the strip of heat sensitive adhesive 106 is increasing. At some juncture, the increasing gas pressure in the cavity 128 (which exerts a separation force on the strip of heat sensitive adhesive 106) and the increasing temperature of the strip of heat sensitive adhesive 106 will reach a point where the strip of heat sensitive adhesive 106 releases. That is, the increasing gas pressure and the increasing temperature (when the temperature of the strip of heat sensitive adhesive 106 reaches the predefined threshold temperature) allows the strip of heat sensitive adhesive 106 to release so that the bottom surface of the first film barrier portion 122 of the film layer 104 separates from the upper surface of the first enclosure barrier portion 116 of the enclosure 102, as conceptually illustrated in FIG. 5.

With the release of the strip of heat sensitive adhesive 106, a passage way from the cavity 128 to the micro-perforation portion 126 of the film layer 104 is created, Accordingly, gas flows from the cavity 128, as conceptually illustrated by the arrows 504, through the micro-perforation portion 126 and out into the ambient region 110, as conceptually illustrated by the arrow 506. Since the gas is passing from the cavity 128 through the micro-perforation portion 126, the flow of gas prevents any contaminants in the ambient region from flowing in the opposite direction through the micro-perforation portion 126 and into the cavity 128. That is, at this juncture, it is not possible for contaminants to enter into the sealable enclosure 100 to contaminate the object 108.

For convenience, the released strip of heat sensitive adhesive 106 is conceptually illustrated as having a portion adhering to the bottom surface of the first film barrier portion 122 of the film layer 104 and another portion that adheres to the upper surface of the first enclosure barrier portion 116 of the enclosure 102. Depending upon the selection of the materials and surface conditions of the first film barrier portion 122 and the first enclosure barrier portion 116, and the material characteristics of the strip of heat sensitive adhesive 106, the release of the strip of heat sensitive adhesive 106 may be different from the illustrated separation of FIG. 5. In some applications, the entirety (or substantially all of) the strip of heat sensitive adhesive 106 may adhere to the first film barrier portion 122 of the film layer 104 after the release. Alternatively, the entirety (or substantially all of) the strip of heat sensitive adhesive 106 may adhere to the first film barrier portion 122 of the enclosure 102.

In some applications, after the heating of the object has been completed, the generation of additional gas ceases. The sealable enclosure 100 may then be moved into a cooling environment so that the sealable enclosure 100 and the object 108 begin to cool. Preferably, the cooling environment is free of contaminants. Alternatively, the heat source may be removed such that the sealable enclosure 100 and the object 108 therein begin to cool.

Depending upon the embodiment, the structure of the sealable enclosure 100 may change as the cooling process proceeds. In one type of embodiment wherein the film layer 104 and the upper portion 114 of the enclosure 102 is flexible, the film layer 104 and the upper portion 114 may collapse as the pressure within the cavity 128 and the interior region 402 decreases as a result of cooling gas within the cavity 128. Even if some contaminants do flow through the micro-perforation portion 126 into the cavity 128, the distance between the micro-perforation portion 118 and the micro-perforation portion 126 may be so great as to make it impossible, or very unlikely, that any contaminates entering in through the micro-perforation portion 126 are able to travel so far as to reach and then pass through the micro-perforation portion 118 to contaminate the object 108.

In other embodiments, the strip of heat sensitive adhesive 106 may be operable to re-seal itself such that the lower surface of the first film barrier portion 122 of the film layer 104 again is affixed to the first enclosure barrier portion 116 of the upper portion 114. Here, the strip of heat sensitive adhesive sealably re-joins the first film barrier portion from the outer surface region of the enclosure barrier portion. Accordingly, the strip of heat sensitive adhesive 106 again acts as a barrier to any contaminants reaching the object 108.

Such embodiments may be particularly useful for sterilization of foods, medical instruments, or other objects.

In some embodiments, the film layer 104 and/or the upper portion 114 of the enclosure 102 may be fabricated from semi-flexible, semi-rigid, and/or rigid materials such that the bottom surface of the upper portion 114 of the enclosure 102 does not collapse onto the object 108. Such embodiments may be desirable in situations such as baking bread or deserts wherein contact of the upper portion 114 of the enclosure 102 might damage the heated object 108.

Figure 6:
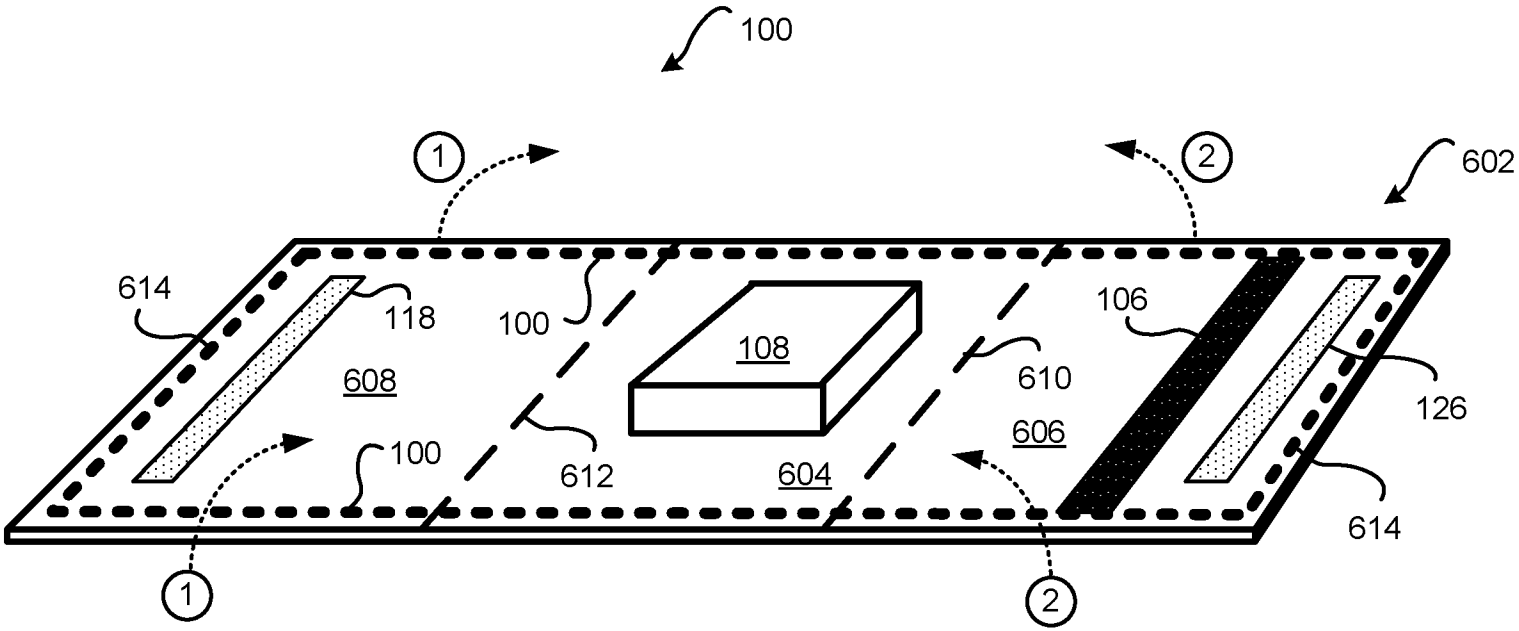
FIG. 6 is a perspective view of a single sheet of packaging with two micro-perforation portions that can be folded and sealed to form a sealable enclosure embodiment.

FIG. 6 is a perspective view of a single sheet 602 of packaging with two micro-perforation portions 118, 126. The sheet 602 can be folded and sealed to form a sealable enclosure embodiment. The sheet 602 is divided into a middle section 604 and two end sections 606 and 608. The middle section 604 and the first end section 606 are separated by a fold line 610. Similarly, the middle section 604 and the second end section 608 are separated by a fold line 612. The size of the individual sections 604, 606, and 608 may be defined based on the nature of the object 108 that is to be sealably enclosed within the sealable enclosure 100.

During fabrication, the micro-perforations are formed in the sheet 602 to create the two micro-perforation portions 118, 126. Then, the strip of heat sensitive adhesive 106 is affixed along the length of the section 606. After the object 108 is placed on the middle section 604, the end section 608 is then folded over the object 108 (conceptually denoted by the arrows 1) along the fold 612. Then, the end section 606 is folded along the fold 610 over the object 108 (conceptually denoted by the arrows 2) covering the previously folded section 608. The edges of the sealable enclosure 100 are then sealed together (along the lines 614) such that the strip of heat sensitive adhesive 106 affixes the now-lower surface of the section 606 to the now-upper surface of the section 608. Accordingly, the object 108 is sealed inside the sealable enclosure 100 and the strip of heat sensitive adhesive 106 now acts as a barrier to contaminants.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and sub-combinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and sub-combinations of the disclosed inventions that are believed to be novel and non-obvious. Inventions embodied in other combinations and sub-combinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A sealable enclosure configured to enclose an object that is to be heated, wherein heating of the sealable enclosure with the object sealed therein permits gas generated by the heating to vent out from the sealable enclosure into an ambient region surrounding the sealable enclosure while preventing ambient contaminates in the ambient region from entering into the sealable enclosure, the sealable enclosure comprising:

an enclosure comprising:

an enclosure barrier portion that is impenetrable to the generated gas and the ambient contaminates; and a first micro-perforation portion that is joined with the enclosure barrier portion to form the enclosure, wherein the first micro-perforation portion is configured to permit the gas generated by the heating to vent out from the enclosure, wherein the enclosure is sealed after the object is inserted therein;

a film layer defined by a first side edge, a second side edge, a front edge and a back edge, wherein the first side edge, the second side edge, the front edge and the back edge are sealably joined to an outer surface region of the enclosure barrier portion of the enclosure such that the film layer portion covers the outer surface region of the enclosure barrier portion and the first micro-perforation portion of the enclosure, and wherein the first micro-perforation portion of the enclosure is proximate to the first edge of the film layer, the film layer comprising:

a first film barrier portion that includes the first side edge and that is impenetrable to the generated gas and the ambient contaminates;

a second film barrier portion that includes the second side edge and that is impenetrable to the generated gas and the ambient contaminates; and a second micro-perforation portion that is disposed between the first film barrier portion and the second film barrier portion, wherein the second micro-perforation portion is configured to permit the gas generated by the heating to vent out from the film layer into the ambient region, and wherein the second micro-perforation portion is proximate to the second side edge of the film layer; and a strip of heat sensitive adhesive extending from the front edge to the back edge of the first film barrier portion, wherein the strip of heat sensitive adhesive is located between the first micro-perforation portion and the second micro-perforation portion, and wherein the strip of heat sensitive adhesive seals a portion of a bottom surface of the first film barrier portion to an outer surface of the enclosure barrier portion.

2. The sealable enclosure of claim 1, wherein in response to the heating of the sealable enclosure with the object sealed therein, the gas that is initially generated within the enclosure by the heating vents out through the first micro-perforation portion into a cavity region formed between the first film barrier portion, the covered outer surface region of the enclosure barrier, and the strip of heat sensitive adhesive, wherein pressure within the cavity generated from the venting gas exerts a separation force tending to separate the first film barrier portion from the outer surface region of the enclosure barrier portion, wherein in response to the strip of heat sensitive adhesive reaching a threshold temperature, the strip of heat sensitive adhesive releases so that the separation force separates the first film barrier portion from the outer surface region of the enclosure barrier portion, and wherein the pressurized gas in the cavity reaches the second micro-perforation portion such that the pressurized gas in the cavity vents out through the second micro-perforation portion into the surrounding ambient region while preventing ambient contaminates from entering into the sealable enclosure.

3. The sealable enclosure of claim 1, wherein after completion of the heating, the pressure in the cavity decreases as the temperature of the gas within the cavity decreases so that the film layer collapses, and wherein the strip of heat sensitive adhesive sealably re-joins the first film barrier portion from the outer surface region of the enclosure barrier portion to form a barrier that prevents contamination of the object.

4. The sealable enclosure of claim 1, wherein the enclosure is a tube of packaging material, and wherein the first edge, the second edge, the front edge and the back edge of the film layer are sealably joined to a selected outer surface region of the tube of packaging material.

5. The sealable enclosure of claim 1, wherein the enclosure barrier portion is a first enclosure barrier portion, and the enclosure further comprises:

a second enclosure barrier portion that is impenetrable to the generated gas and the ambient contaminates, wherein the first micro-perforation portion is disposed between the first enclosure barrier portion and the second enclosure barrier portion to form the enclosure.

6. The sealable enclosure of claim 1, wherein the enclosure barrier portion and the first micro-perforation portion form an upper portion of the enclosure, and wherein the enclosure further comprises:

a base portion that is sealably joined with the upper portion.

7. The sealable enclosure of claim 6, wherein the base portion is made of a rigid material that supports the object.

8. The sealable enclosure of claim 6, wherein the enclosure barrier portion is made of a semi-flexible or semi rigid material that prevents the enclosure barrier portion from collapsing onto the surface of the object after the heating has been completed.

9. The sealable enclosure of claim 1, wherein the first side edge, the second side edge, the front edge and the back edge are sealably joined to the outer surface region of the enclosure barrier portion of the enclosure using an adhesive.

10. The sealable enclosure of claim 9, wherein the adhesive that sealably joins first side edge, the second side edge, the front edge and the back edge are sealably joined to the outer surface region of the enclosure barrier portion of the enclosure does not separate at a temperature that is less than or equal to the threshold temperature at which the heat sensitive adhesive releases.

11. The sealable enclosure of claim 1, wherein the first side edge, the second side edge, the front edge and the back edge are sealably joined to the outer surface region of the enclosure barrier portion of the enclosure using heat and pressure.

12. The sealable enclosure of claim 1, wherein the first side edge, the second side edge, the front edge and the back edge are sealably joined to the outer surface region of the enclosure barrier portion of the enclosure using a crimp.

13. A sealable enclosure configured to enclose an object that is to be heated, wherein heating of the sealable enclosure with the object sealed therein permits gas generated by the heating to vent out from the sealable enclosure into an ambient region surrounding the sealable enclosure while preventing ambient contaminates in the ambient region from entering into the sealable enclosure, the sealable enclosure comprising:

a tubular enclosure comprising:

an enclosure barrier portion that is impenetrable to the generated gas and the ambient contaminates; and a first micro-perforation portion that permits the gas generated by the heating to vent out from the enclosure;

a film layer defined by a first side edge, a second side edge, a front edge and a back edge, wherein the first side edge, the second side edge, the front edge and the back edge are sealably joined to an outer surface region of the enclosure barrier portion of the enclosure such that the film layer portion covers the outer surface region of the enclosure barrier portion and the first micro-perforation portion of the enclosure, and wherein the first micro-perforation portion of the enclosure is proximate to the first edge of the film layer, the film layer comprising:

a first film barrier portion that includes the first side edge and that is impenetrable to the generated gas and the ambient contaminates;

a second film barrier portion that includes the second side edge and that is impenetrable to the generated gas and the ambient contaminates; and a second micro-perforation portion that is disposed between the first film barrier portion and the second film barrier portion, wherein the second micro-perforation portion is configured to permit the gas generated by the heating to vent out from the film layer into the ambient region, and wherein the second micro-perforation portion is proximate to the second side edge of the film layer; and a strip of heat sensitive adhesive extending from the front edge to the back edge of the first film barrier portion, wherein the strip of heat sensitive adhesive is located between the first micro-perforation portion and the second micro-perforation portion, and wherein the strip of heat sensitive adhesive seals a portion of a bottom surface of the first film barrier portion to an outer surface of the enclosure barrier portion.

14. The sealable enclosure of claim 13, wherein in response to the heating of the sealable enclosure with the object sealed therein, the gas that is initially generated within the enclosure by the heating vents out through the first micro-perforation portion into a cavity region formed between the first film barrier portion, the covered outer surface region of the tubular enclosure, and the strip of heat sensitive adhesive, wherein pressure within the cavity generated from the venting gas exerts a separation force tending to separate the first film barrier portion from the outer surface region of the enclosure barrier portion, wherein in response to the strip of heat sensitive adhesive reaching a threshold temperature, the strip of heat sensitive adhesive releases so that the separation force separates the first film barrier portion from the outer surface region of the enclosure barrier portion, and wherein the pressurized gas in the cavity reaches the second micro-perforation portion such that the pressurized gas in the cavity vents out through the second micro-perforation portion into the surrounding ambient region while preventing ambient contaminates from entering into the sealable enclosure.

15. The sealable enclosure of claim 13, wherein the tubular enclosure is made of a semi-flexible or semi rigid material that prevents the tubular enclosure from collapsing onto the surface of the object after the heating has been completed.

16. The sealable enclosure of claim 13, wherein the first side edge, the second side edge, the front edge and the back edge are sealably joined to the outer surface region of the enclosure barrier portion of the enclosure using an adhesive.

17. A method of heating an object that is enclosed within a sealable enclosure, wherein heating of the sealable enclosure with the object sealed therein permits gas generated by the heating to vent out from the sealable enclosure into an ambient region surrounding the sealable enclosure while preventing ambient contaminates in the ambient region from entering into the sealable enclosure, wherein the sealable enclosure is defined by an enclosure comprising:

an enclosure barrier portion that is impenetrable to the generated gas and the ambient contaminates; and a first micro-perforation portion that is joined with the enclosure barrier portion to form the enclosure, wherein the first micro-perforation portion is configured to permit the gas generated by the heating to vent out from the enclosure, wherein the enclosure is sealed after the object is inserted therein;

wherein the sealable enclosure further defined by an enclosure a film layer defined by a first side edge, a second side edge, a front edge and a back edge, wherein the first side edge, the second side edge, the front edge and the back edge are sealably joined to an outer surface region of the enclosure barrier portion of the enclosure such that the film layer portion covers the outer surface region of the enclosure barrier portion and the first micro-perforation portion of the enclosure, and wherein the first micro-perforation portion of the enclosure is proximate to the first edge of the film layer, the film layer comprising:

a first film barrier portion that includes the first side edge and that is impenetrable to the generated gas and the ambient contaminates;

a second film barrier portion that includes the second side edge and that is impenetrable to the generated gas and the ambient contaminates; and a second micro-perforation portion that is disposed between the first film barrier portion and the second film barrier portion, wherein the second micro-perforation portion is configured to permit the gas generated by the heating to vent out from the film layer into the ambient region, and wherein the second micro-perforation portion is proximate to the second side edge of the film layer; and wherein the sealable enclosure is further defined by an enclosure a strip of heat sensitive adhesive extending from the front edge to the back edge of the first film barrier portion, wherein the strip of heat sensitive adhesive is located between the first micro-perforation portion and the second micro-perforation portion, and wherein the strip of heat sensitive adhesive seals a portion of a bottom surface of the first film barrier portion to an outer surface of the enclosure barrier portion, the method comprising:

heating the sealable enclosure with the object sealed therein, wherein gas that is initially generated within the enclosure by the heating vents out through the first micro-perforation portion into a cavity region formed between the first film barrier portion, the covered outer surface region of the enclosure barrier, and the strip of heat sensitive adhesive, wherein pressure within the cavity generated from the venting gas exerts a separation force tending to separate the first film barrier portion from the outer surface region of the enclosure barrier portion, wherein in response to the strip of heat sensitive adhesive reaching a threshold temperature, the strip of heat sensitive adhesive releases so that the separation force separates the first film barrier portion from the outer surface region of the enclosure barrier portion, and wherein the pressurized gas in the cavity reaches the second micro-perforation portion such that the pressurized gas in the cavity vents out through the second micro-perforation portion into the surrounding ambient region while preventing ambient contaminates from entering into the sealable enclosure.

18. The method of claim 17, wherein after completion of the heating, the method further comprising:

Removing the sealable enclosure with the object sealed therein from a first ambient region where the heating occurred;

Moving the sealable enclosure with the object sealed therein to a second ambient region that is contaminate free; and cooling the sealable enclosure with the object sealed therein.

19. The method of claim 17, wherein after completion of the heating, the method further comprising:

cooling the sealable enclosure with the object sealed therein, wherein the pressure in the cavity decreases as the temperature of the gas within the cavity decreases so that the film layer collapses, and wherein the strip of heat sensitive adhesive sealably re-joins the first film barrier portion from the outer surface region of the enclosure barrier portion to form a barrier that prevents contamination of the object.

* * * * *